United States Patent [19]

Borys

[11] Patent Number: 4,651,482

[45] Date of Patent: Mar. 24, 1987

[54] CORNER CONSTRUCTION FOR PREFABRICATED SPACER FOR MULTIPLE-GLAZED WINDOWS

[76] Inventor: Ryszard Borys, 21990 6th Ave., Lake Villa, Ill. 60046

[21] Appl. No.: 721,795

[22] Filed: Apr. 10, 1985

[51] Int. Cl.[4] ..... E06B 7/12; E06B 3/96

[52] U.S. Cl. ..... 52/172; 52/475; 52/656

[58] Field of Search ..... 52/172, 656, 658, 399, 52/475, 99; 403/295; 285/3

[56] References Cited

U.S. PATENT DOCUMENTS

| | | | |
|---|---|---|---|
| 2,173,649 | 9/1939 | Firner | 52/172 X |
| 3,294,430 | 12/1966 | Halip | 52/656 |
| 3,492,034 | 1/1970 | Skipp | 403/295 |
| 3,952,473 | 4/1976 | Jesse | 52/656 |
| 3,967,910 | 7/1976 | Tollefsrud | 403/295 X |
| 4,183,693 | 1/1980 | Berdan | 52/656 X |
| 4,296,587 | 10/1981 | Berdan | 52/656 X |

FOREIGN PATENT DOCUMENTS

| | | | |
|---|---|---|---|
| 2521630 | 8/1983 | France | 52/788 |

*Primary Examiner*—William F. Pate, III
*Assistant Examiner*—Jean M. LaKemper
*Attorney, Agent, or Firm*—Laff, Whitesel, Conte & Saret

[57] ABSTRACT

A corner piece for connecting adjacent hollow spacer members to form a spacer frame used in the construction of thermally insulated windows. The corner piece includes horizontal and vertical legs forming a right angle. One end of each leg has a cutting edge. When the ends of each leg are inserted into a hollow spacer which has internal partitions, the sharpened cutting edge is able to cut around the adjacent partition and thus enter the spacer fully. The corner piece is constructed in a manner which permits sealant to be injected into the corner pieces and the spacers after assembly to seal off any gaps around the installed corner piece.

15 Claims, 15 Drawing Figures

CORNER CONSTRUCTION FOR PREFABRICATED SPACER FOR MULTIPLE-GLAZED WINDOWS

This invention relates to insulated windows comprising two or more panes of glass, and is particularly directed to improved corner pieces used to connect prefabricated spacers separating adjacent panes.

BACKGROUND OF THE INVENTION

Conventional insulated windows employ a plurality of panes of glass which trap air therebetween to serve a thermal insulation function. Prefabricated, elongated hollow spacers, connected in a rectangular frame configuration, are normally placed at the top, bottom and sides of each such air space to physically separate the adjacent panes.

A common problem with multi-glazed windows is that moisture trapped between the adjacent panes condenses on the panes, causing them to become clouded or fogged. Generally, this problem is dealt with by putting desiccant material inside the hollow spacers to absorb the moisture, thereby preventing condensation.

Generally, the prefabricated spacers consist of pieces of elongated sheet metal folded into a hollow cross-sectional shape to define an interior compartment within which the desiccant is contained. Prior to installation, the spacer is sealed at each end with a sealing plug to prevent ambient moisture from coming into contact with the desiccant material. During installation, the spacer is cut to the appropriate size, after which the sealing plugs are replaced with corner pieces inserted in the ends of adjacent spacer members. Each corner piece is formed with a horizontal leg and a vertical leg disposed at a 90° angle, each leg being inserted into the end of one of the adjacent spacers to hold the two adjacent spacers together and in perpendicular relation to one another.

The weakest point of a multiple-glazed window, with respect to moisture leakage, is the corner. The corner pieces generally do not make a moisture-tight seal against the window panes, thereby allowing moisture to leak in and thus significantly reducing the life of the window.

When each leg of the corner piece is inserted into a spacer, a sealing compound is applied around the corner piece and spacers in order to seal any gaps by which ambient moisture could enter. But moisture leakage problems nevertheless arise when, due to changes in temperature and air pressure, the spacers pull away from the corner piece, creating openings through which ambient moisture can enter.

A preferred type of spacer is illustrated in my copending patent application Ser. No. 721,796, filed on the same date as this application, entitled "Prefabricated Spacer for Multiple-Glazed Windows." This spacer has a plurality of interior partitions, each formed of a body of moisture-barrier material maintained in a sealing relationship with the interior walls of the compartment. The partitions are spaced at intervals along the length of the spacer, thereby dividing the spacer into subcompartments which each contain desiccant material.

When this type of spacer is cut to a shorter length to accommodate the size of the window, the only desiccant material in the hollow interior which is exposed to ambient moisture is that which is within the particular subcompartment which is cut, thereby minimizing loss of the desiccant. Conventional corner pieces are usually solid metal or plastic bodies with rounded, blunt or squared-off ends. When used with the type of spacer described in my above-mentioned Patent Application, the rounded or blunt ends run up against the partitions. The corner piece then will not be able to fit all the way into the spacer, or may push the partition out of place.

BRIEF SUMMARY OF THE INVENTION

The present invention is an improvement over the type of corner pieces commonly used with prefabriciated window spacers. It provides a corner piece with ends having cutting edges to cut past the partitions inside the spacers. It is preferably also formed with a hollow portion facing outwardly so that it can be filled with sealant after assembly of the spacer frame. Some forms of the invention are also able to fit a greater variety of cross-sectional shapes of spacer members.

Such a corner piece may be made from aluminum, copper, zinc or some other ductile metal. Molded plastic may also be used, but is not preferred because of thermal expansion incompatibilities. Sheet metal may be extruded, or folded into a channel or some equivalent hollow shape, and then bent into a 90° angle. The hollow portion of the channel is facing outwardly after it is bent to the proper angle.

Certain shapes, such as a T or equivalent, make the corner piece useful for a wider variety of spacer cross-sections, particularly non-rectangular channels.

The outwardly facing hollow allows the interior of the corner piece, as well as the inside of the spacer, to be filled with sealant, creating a more effective seal.

Each end of the corner piece has a cutting edge, which may be raked at an angle to assist the corner piece in cutting past the partition. The partition will then form a seal against the corner piece which has cut past it.

The features and advantages of the invention will be more fully appreciated from the following drawings and detailed description of an illustrative embodiment.

DETAILED DESCRIPTION OF THE PREFERRED EMBODIMENT

Figure 1:
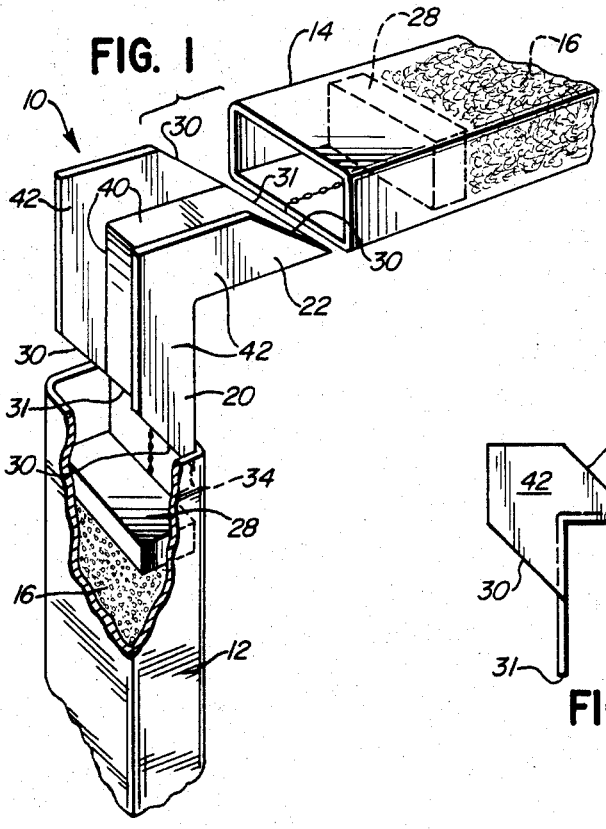
FIG. 1 is a perspective view of a corner piece in accordance with this invention in position for insertion into two adjacent spacers.

The present invention provides a corner piece 10 which is adapted to connect adjacent hollow spacers 12 and 14 at right angles to each other for use in a thermally insulated window.

Typically a window of the uninsulated or single-glazed type, i.e. comprising a single pane of glass, is converted to the insulated or double-glazed type by adding a second pane on the indoor side of the first pane. The two panes are separated by a rectangular spacer frame which consists of a top, bottom and two side spacers. Thus, the two panes of glass trap between them an air space which serves the purpose of thermal insulation. The interiors of these hollow spacers 12 and 14 contain a conventional granular desiccant material 16 throughout the length of the spacer 14, which serves to prevent condensation of moisture in that air space from fogging the glass panes.

Spacers 12 and 14 are often prefabricated at factory locations, and later installed at the site of the building where the retrofit operation is being carried out. They are made in standard lengths which generally exceed window dimensions, and are then cut to fit the windows at the time of installation. In the past, a plug was provided at each cut end of the spacers to keep the desiccant material 16 from falling out. When the spacer was cut to size, the open ends of the spacer were fitted with L-shaped corner pieces of a prior art type to connect top, bottom and two side spacers at right angles to form a rectangular spacer frame.

In order to prevent loss of the desiccant from most of the length of the spacer, the new and improved spacer of the above-mentioned co-pending patent application has moisture barrier partitions 28 longitudinally spaced at small intervals along the length of the spacers 12 and 14, to divide the interior of each spacer into subcompartments, each containing a quantity of desiccant material. Thus, when the prefabricated spacer 12 or 14 is cut to size at the building site, the amount of desiccant material 16 which is lost or exposed to ambient moisture is limited to that which is contained in the last subcompartment at each end.

In the past, corner pieces were formed with blunt ends. A problem arises when this new spacer is used with such blunt-ended corner pieces, because the latter could only be inserted part-way into the spacers 12 and 14 before they were blocked by the first partition 28. Therefore, some means must be provided for the ends of the corner piece 10 to get past any partition 28 it encounters.

Figure 2:
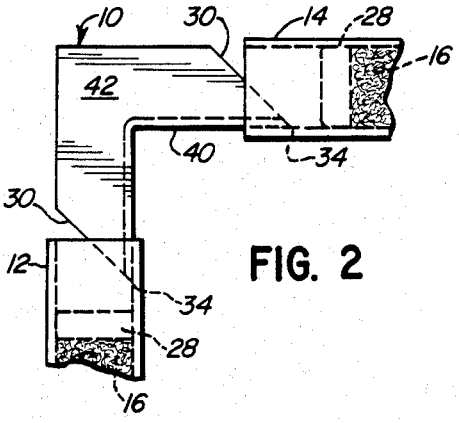
FIG. 2 is a side elevational view of the corner piece being inserted into the adjacent spacers.
Figure 3:
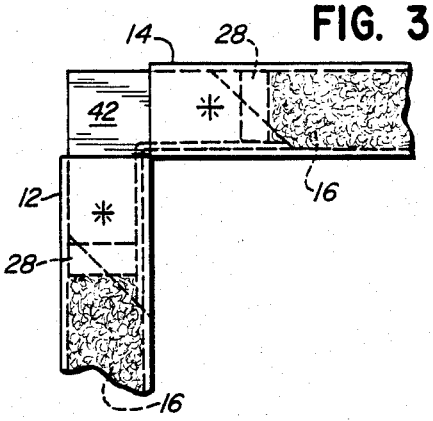
FIG. 3 is a side elevational view of the corner piece and spacers fully assembled.

Corner pieces 10 are formed with a vertical leg 20 and horizontal leg 22 at a right angle thereto. They are preferably made of a ductile metal such as zinc or aluminum, but may also be molded of a plastic material. The vertical and horizontal legs of each corner piece 10 are aligned with the ends of adjacent spacers 12 and 14 (see FIGS. 1 and 2) and inserted as seen in FIG. 3, thereby connecting top, bottom and side spacers to form a rectangular spacer frame. In the past, the corners of a thermally insulated window have been the weakest point of the window, i.e. the most prone to moisture leakage, thereby significantly decreasing the useful life of the window.

In accordance with the present invention, the corner piece 10 is made of a sheet-thin material formed with an open cross-section (for example, channel-shaped) so as to provide cutting edges 30 and 31. The cutting efficacy of edges 30 is preferably enhanced by raking the edge to about a 45° angle, thus forming sharpened points 34 (see FIG. 2).

When the spacers 12 and 14 are cut to size to fit the window in which they are being installed, and the corner piece 10 is inserted thereinto, the cutting edges 30 and 31 of the corner piece 10 will be able to cut around the partition 28 without dislodging it, and the partition will form a seal against the corner piece 10, thereby preventing exposure of desiccant 16 to ambient moisture.

Figure 8:
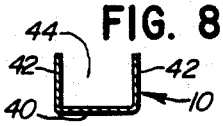
FIGS. 8–14 are cross-sectional views of alternative corner pieces in accordance with this invention.

The preferred form of corner piece 10 is that seen in FIGS. 1 through 4 and 8, which has the U-shaped open channel cross-section illustrated in FIG. 8, including a central member 40 and side members 42 upstanding therefrom. The cutting edges 30 are formed at opposite ends of each side member, and the cutting edges 31 are formed at opposite ends of the central member 40.

The cross-sectional shape of the corner piece 10 can be formed by extrusion, or alternatively from a piece of flat sheet metal by first folding the side members 42 out of the plane of the central member 40 to define the U-shaped configuration. In either case, the corner piece is subsequently bent into a right angle to define the two legs 20 and 22. The metal of which the corner piece is made must be sufficiently ductile for the side members 42 to stretch around a corner when the latter operation is performed.

In addition to permitting the corner piece 10 to cut its way past the partition 28, the open cross-sectional shape of the corner piece serves an additional function: it provides an interior cavity 44 (FIG. 8) between confronting side members 42. A sealing compound can be injected into the cavity 44 and into the interior of the hollow spacers 12 and 14 (between the partitions 28 thereof) even after the spacer frame has been assembled as indicated by FIG. 3. This additional sealing compound greatly improves the moisture penetration resistance of the corner region compared to prior art structures.

Therefore, after the corner piece 10 is fully inserted (see FIG. 3), thereby joining the spacers 12 and 14, sealant is injected into the cavity 44 in sufficient quantities to fill the spacers 12 and 14 up to their respective partitions 28, and also to fill the portion of cavity 44 which lies between the ends of the spacers 12 and 14 (see FIG. 3).

In order to permit such injection of sealant, it is essential that the corner piece have a U-shaped channel shape or other open cross-section in which the hollow side faces outwardly, to permit the sealant to be injected into the interior of the spacers 12 and 14 and the cavity 44 of the corner piece 10 after the spacer frame is assembled.

When the corner pieces and spacers expand and contract with changes in temperature, they tend to pull away from the window frame 10, thereby causing a moisture-admitting gap in the corner area. With the present invention, the leakage of ambient moisture is minimized because of the presence of the sealant in the cavity 44, which adheres to the surrounding surfaces despite thermal expansion and contraction.

Figure 4:
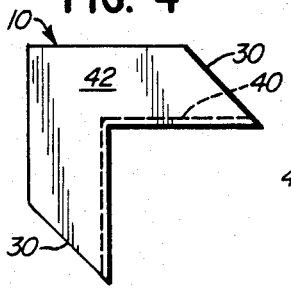
FIG. 4 is a side elevational view of the corner piece of FIG. 1.
Figure 5:
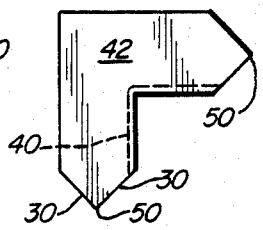
FIGS. 5, 6 and 7 are elevational views of alternative embodiments of corner pieces in accordance with this invention.
Figure 6:
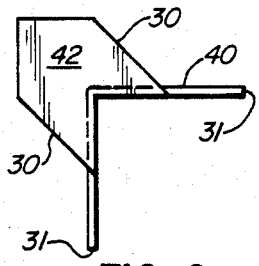
Figure 7:
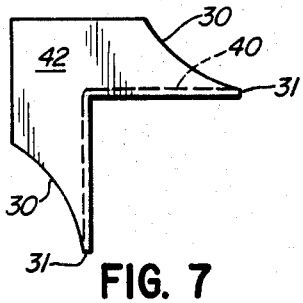

The profile of the corner piece 10 seen in FIG. 4 is not the only one which is feasible. The profiles of FIGS. 5 through 7, among others, may also be used. In the profile of FIG. 5 the edges 30 are raked in both directions to form a centrally located point 50 instead of the point 34. In FIG. 6 the walls 40 are foreshortened so that edges 30 are located behind edges 31. In FIG. 7 the edges 30 are curved concavely for still greater cutting efficacy.

Figure 9:
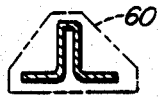
Figure 11:
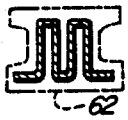
Figure 13:
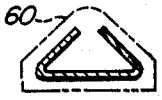
Figure 10:
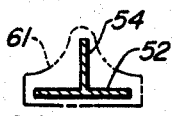
Figure 12:
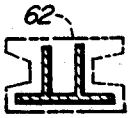
Figure 14:
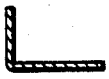

Similarly, the cross-sectional shape of the corner piece 10 illustrated in FIG. 8 is not the only one which is feasible. Those of FIGS. 9 through 14 will also work satisfactorily. The cross-section seen in FIG. 9 is a folded or extruded T-shaped channel. That of FIG. 10 is a simple T-shaped channel, in which a base member 52 is welded to a wall member 54. FIG. 11 depicts a double folded or extruded T-shaped channel, and FIG. 12 a double T channel similar in construction to the embodiment of FIG. 10. FIG. 13 shows a folded or extruded triangular cross-sectional channel configuration. And FIG. 14 shows a folded or extruded L-shaped cross-sectional channel configuration.

The cross-sectional shapes of FIGS. 9 through 13 have a particular advantage, in that they fit within various non-rectangular cross-sections of hollow spacers, indicated by dashed lines 60 through 62, which are commonly employed in the industry, as well as within the rectangular cross-section spacers 12 and 14. Thus, the double T configuration of FIG. 9, the simple T of FIG. 10, and the triangular shape of FIG. 13 fit within the triangular spacer outline 60 and the curved triangular shape 61. Similarly, the double T shapes of FIGS. 11 and 12 fit within an indented rectangular spacer outline 62. This greatly simplifies the inventory of corner types which must be stocked.

Figure 15:
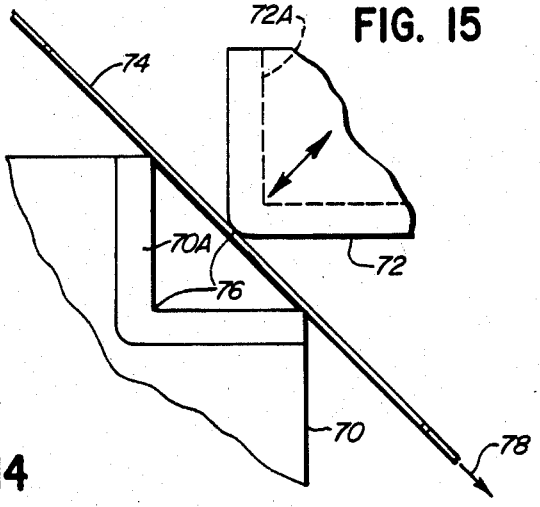
FIG. 15 is a cross-sectional view of a mechanism for producing a corner piece in accordance with this invention in one step by die-stamping a piece of sheet metal.

FIG. 15 illustrates a male die 70 and a female die 72 designed for die-stamping the corner piece 10 of FIGS. 1–4 and 8 in a single operation from a continuously fed piece of ductile sheet metal 74. A male boss 70A on die 70 forms the U-shaped cross-section seen in FIG. 8 by cooperating with a female cavity 72A on die 72. Dies 70 and 72 are formed with complementary right angle vertices 76 to bend the corner piece into the desired right angle shape at the same time that the U-shaped cross-section is formed. The sheet 74 may be fed in the direction indicated by arrow 78 to make the process continuous. Each newly formed corner piece may be severed from the sheet 74 as it is stamped out by the dies 70 and 72.

It will now be appreciated that the present invention provides an improved corner piece to be used with prefabricated spacers which has significant advantages in the retrofitting of multi-glazed windows.

The invention claimed is:

1. A corner piece adapted for joining two hollow window spacers at least one of which is of the type containing a desiccant and at least one partition, said corner piece comprising two legs at an angle to each other, the outer extremity of at least one leg being formed of a sheet-like member terminating in a cutting edge of sufficient sharpness to readily cut said partition.

2. A corner piece as in claim 1 wherein said corner piece has a cross-sectional shape which is open in an outward direction relative to said angle, whereby to permit injection of sealant into said open corner pieces after assembly with said spacers.

3. A corner piece adapted for joining adjacent spacer members, at least one of which is of the type containing a desiccant and at least one partition, said corner piece comprising:

a vertical leg and a horizontal leg;

and cutting edge means on the end of at least one leg which is of sufficient sharpness for readily cutting said partition.

4. A corner piece as in claim 3 wherein:

said cutting edge means is raked to form an angle which facilitates cutting.

5. A corner piece as in claim 3, wherein:

said corner piece is formed of ductile sheet material formed into a channel configuration;

the interior of said channel configuration facing radially outwardly of the angle of said corner piece to allow sealant to be injected into said channel and into the spacer members after said corner piece is installed.

6. A corner piece as in claim 3 having a substantially U-shaped cross-sectional shape.

7. A corner piece as in claim 3 having a substantially T-shaped cross-sectional shape.

8. A corner piece as in claim 7 wherein said T-shaped cross-section is folded to form a double-thickness center leg.

9. A corner piece as in claim 7 wherein said T-shaped cross-section has two center legs.

10. A corner piece as in claim 9 wherein said center legs are folded to achieve a double thickness.

11. A corner piece as in claim 3 having a substantially triangular cross-sectional shape.

12. A corner piece as in claim 3 having a substantially L-shaped cross-sectional shape.

13. A window spacer assembly comprising:

at least two hollow window spacers, at least one of which is of the type containing a desiccant and at least one partition;

a corner piece comprising two legs at an angle to each other;

the outer extremity of at least one of said legs being formed of a sheet-like member terminating in a cutting edge;

each of said legs being received within a respective one of said spacers whereby said corner piece assembles said spacers into an angular relationship with each other;

said cutting edge being cuttingly engaged with said partition in the interior of said hollow spacer.

14. An assembly as in claim 13 in which said edge is of sufficient sharpness to readily cut said partition.

15. An assembly as in claim 13 wherein said corner piece has a cross-sectional shape which is open in an outward direction relative to said angle, whereby to permit injection of sealant into said open corner piece when it is assembled with said spacers.

* * * * *